US007897236B2

(12) United States Patent
Merovitz

(10) Patent No.: US 7,897,236 B2
(45) Date of Patent: Mar. 1, 2011

(54) ELECTROSTATIC FLOCKING AND ARTICLES MADE THEREFROM

(75) Inventor: Gerald Merovitz, Dover, DE (US)

(73) Assignee: Playtex Products, Inc., Westport, CT (US)

( * ) Notice: Subject to any disclaimer, the term of this patent is extended or adjusted under 35 U.S.C. 154(b) by 1414 days.

(21) Appl. No.: 10/458,772

(22) Filed: Jun. 10, 2003

(65) Prior Publication Data

US 2004/0033334 A1 Feb. 19, 2004

(51) Int. Cl.

| | |
|---|---|
| ***B05D 1/06*** | (2006.01) |
| ***B05D 1/14*** | (2006.01) |
| ***B05D 1/16*** | (2006.01) |
| ***A41D 19/00*** | (2006.01) |
| ***A41D 19/15*** | (2006.01) |

(52) U.S. Cl. ..... 428/90; 2/159; 2/168; 427/206; 427/181; 427/462; 427/465

(58) Field of Classification Search ..... 428/90; 2/159, 167, 168; 427/206, 181, 462, 465
See application file for complete search history.

(56) References Cited

U.S. PATENT DOCUMENTS

| | | | | |
|---|---|---|---|---|
| 4,319,942 A * | 3/1982 | Brenner | ..... | 156/72 |
| 4,535,121 A * | 8/1985 | Oezelli et al. | ..... | 524/715 |
| 4,668,323 A * | 5/1987 | Lenards et al. | ..... | 156/242 |
| 4,835,226 A * | 5/1989 | Warren et al. | ..... | 525/504 |
| 4,918,119 A * | 4/1990 | Seltmann et al. | ..... | 523/461 |
| 5,185,402 A * | 2/1993 | Fleming et al. | ..... | 525/130 |
| 5,403,884 A * | 4/1995 | Perlinski | ..... | 524/524 |
| 6,924,000 B2 * | 8/2005 | Tallmadge | ..... | 427/206 |

FOREIGN PATENT DOCUMENTS

| | | | |
|---|---|---|---|
| EP | 1072712 A1 * | 1/2001 | |
| FR | 2448307 A * | 10/1980 | |
| JP | 2001198997 A * | 7/2001 | |
| JP | 2001270019 A * | 10/2001 | |

* cited by examiner

*Primary Examiner*—Cheryl Juska
(74) *Attorney, Agent, or Firm*—Ohlandt, Greeley, Ruggiero & Perle, L.L.P.

(57) ABSTRACT

The present invention is directed to an article having at least one surface coated with electrostatically flocked material. The flock material used is one or more fibers, preferably synthetic fibers. When electrostatically flocked onto the article surface, the flock material is oriented, thus providing a silky smooth feel to the surface. The articles may include, for example, elastic articles such as rubber gloves, elastic medical drapes or wraps, elastic orthopedic supports/braces and clothing. The present invention also provides a process and apparatus for electrostatically flocking material onto an article.

52 Claims, 1 Drawing Sheet

ELECTROSTATIC FLOCKING AND ARTICLES MADE THEREFROM

RELATED APPLICATION

This application claims priority from Provisional Patent Application Ser. No. 60/387,481, filed on Jun. 10, 2002, pending.

BACKGROUND OF THE INVENTION

1. Field of the Invention

The present invention relates to an elastic article with at least one surface having densely populated orientated fibers and a process and apparatus for the manufacture of the article. More particularly, the present invention is directed to an electrostatically flocked glove and a process and apparatus for making the flocked glove.

2. Description of the Prior Art

The present method for applying flock to latex or latex/neoprene articles involves coating the article with a thin layer of latex adhesive and pneumatically blowing flock (most commonly chopped cotton) into the latex adhesive layer while the adhesive is still wet. The flocked latex article is then heated until the latex is dried and cured. The curing results in the cross-linking of the latex polymer molecules by sulfur bonds, or other cross-linking agents/mechanisms which provide memory to the polymer structure, so when stretched it will rebound to its original cured shape. The cured latex adhesive layer is imbedded with the flock. In the case of gloves, the glove is inverted, thus flipping the flocked layer to the inside of the glove. Loose, excess flock can then be removed from the article by washing and drying in a tumbler, chlorinating and drying in a tumbler, or just tumbling, depending on the process. The flocked surface provides a slip layer for donning or removing the glove and absorbing hand moisture.

One major drawback with the present method is that it does not allow the flock to be oriented, since the cotton flock is prepared by chopping and crushing scrap cotton fabric, resulting in random cut lengths of various shapes and sizes. The chopped cotton is pneumatically applied, so the flock adheres to the latex adhesive in whatever random orientation it first contacts the adhesive surface. Thus, the cotton fiber may provide a slip coating for donning and some moisture absorption but it does not provide a smooth, silky, slippery, finished feel, as desired by a glove user.

Electrostatic application of flock to a non-uniform surface, such as a rubber glove surface, can be problematic due to the convoluted surface. When the article is a glove, the glove is typically rotated in an electrical field in order to present all surfaces to the electrostatic applicator. A typical rubber glove manufacturing operation is a continuous conveyer system or conveyer batch system where individual glove rotation may not possible. Therefore the flocking operation must be designed to be a continuous system and designed to keep up with manufacturing speeds. Moreover, the electrostatic flock that has been spent through the charging nozzle or plate needs to be collected and returned through the flock system for another opportunity at adhesion to the adhesive layer on subsequent articles that are being continuously conveyed through the flocking system.

Presently, a known process used to apply an electrostatic flock layer to a polyvinyl chloride polymer (PVC) glove includes the use of non-elastic waterproof adhesives. Since a vinyl glove does not stretch in the typical fashion of rubber articles, the complexity of a waterproof adhesive associated with rubber articles is not experienced, as non-elastic waterproof adhesives are readily available. High temperature cure adhesives are easily applied to the PVC glove since the PVC requires temperatures exceeding 300° F. Thus, the glove and adhesive temperature is matched. However, this technology cannot be equally applied to rubber or rubber-based articles, such as gloves. High temperature cure adhesives are incompatible with rubber-based gloves, since rubber will typically begin to degrade at temperatures of 300° F. and above.

Therefore, there is a need in the art for an efficient process for forming a flocked rubber-based article, such as a glove. The present invention provides for an efficient process that results in an electrostatically flocked rubber-based glove with a smooth, silky feel, which is also very soft, elastic and comfortably flexible. The present invention is achieved in part through the electrostatic application of precision cut, perpendicularly oriented fibers to a glove surface having an elastic adhesive system. Perpendicular orientation and close packing of the electrostatic fibers also allows for much greater moisture absorption to keep hands drier.

SUMMARY OF THE INVENTION

It is an object of the present invention to provide an article with at least one surface coated with electrostatically flocked material.

It is another object of the present invention to provide such an article that is an elastic article.

It is yet another object of the present invention to provide such an elastic article with at least one surface coated with an electrostatically oriented flock fiber.

It is a further object of the present invention to provide such an elastic article with an elastic adhesive system for adhering the flock to the surface of the elastic article.

It is still a further object of the present invention to provide a process for making an electrostatically flocked article.

It is yet a further object of the present invention to provide an apparatus for making an electrostatically flocked article.

In brief summary, the present invention provides an article having at least one surface coated with electrostatically flocked material. The flock material used is one or more fibers and preferably one or more synthetic, precision length cut fibers. When electrostatically flocked onto the article surface, the flock material is perpendicularly, or virtually perpendicularly, oriented in an elastic adhesive, thus providing a silky smooth feel to the surface of the elastic article. The present invention also provides a process and apparatus for electrostatically flocking material onto an article.

DETAILED DESCRIPTION OF THE INVENTION

Figure 1:
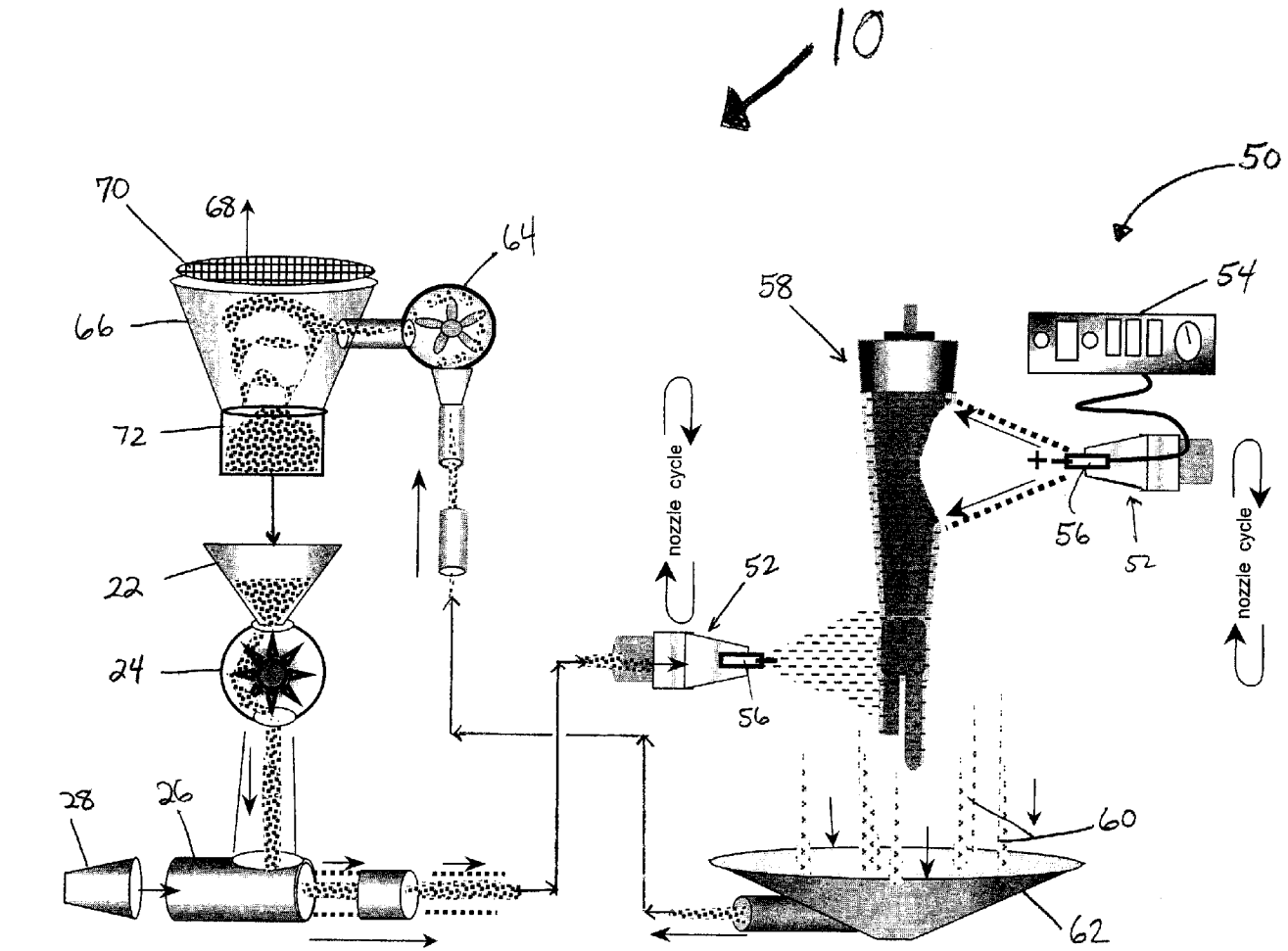
FIG. 1 is a plan view of a flocking apparatus according to the present invention.

The present invention provides an article with at least one surface having electrostatically flocked material. Preferably, the electrostatically flocked material is coated to at least one surface. The material is oriented on the surface of the article, thus providing a soft, silky feel. Suitable articles include, but are not limited to, a glove, a medical wrap, a sport related support wrap for joints (i.e., wrist, knee, elbow and ankle), or other items such as clothing, and any other item where a flocked surface is desired. In a preferred embodiment of the present invention, the article is a highly elastic article such as, for example, a rubber-based household glove.

As used herein, a rubber-based article is one that may include, among other constituents, natural rubber, synthetic rubber as defined in ASTM D1566-98, or any combinations thereof.

The elastic article according to the present invention may be formed by one or more layers of elastic material. When two or more layers of elastic material are used, the elastic article may be referred to as a laminate or a laminate structure. In forming a laminate structure, each layer of material may be of the same elastic material, or each layer could be of differing elastic materials. The final elastic article, regardless of its construction, should meet a Tensile Set of under 40% of the original elongation as tested by ASTM D412-98, to which the elastic article is strained to no less than 80% of its ultimate elongation. Preferably, the final elastic article, regardless of its construction, should meet a Tensile Set of under 30% of the original elongation as tested by ASTM D412-98, to which the elastic article is strained to no less than 80% of its ultimate elongation. Most preferably, the final elastic article, regardless of its construction, should meet a Tensile Set of under 20% of the original elongation as tested by ASTM D412-98, to which the elastic article is strained to no less than 80% of its ultimate elongation.

Suitable flock material for use with the present invention includes, but is not limited to, rayon, nylon, polyester, acrylic, or any combinations thereof. Preferably, the flock material is in fiber form and is precision cut. In a preferred embodiment of the present invention, the fiber is precision cut rayon.

To orient the fibers in a substantially perpendicular plane, the fiber used is treated with a material or coating to provide each fiber with a negative and positive charged (polarized) end. Any suitable coating that polarizes a fiber may be used in the present invention. Suitable polarizing coatings include commercially available AC (Alternating Current) or DC (Direct Current) type coatings, depending on the electrostatic flocking system selected.

It has been found that by controlling both the length of the fiber and the denier of the fiber used in the electrostatic flocking process, optimization of not only the manufacturing efficiency, but also the feel and performance of the elastic article is achieved.

The fibers used in the present invention have a length of about 0.005 inches to about 0.25 inches. Preferably, the fibers have a length of about 0.01 inches to about 0.03 inches, and more preferably about 0.012 inches to about 0.025 inches.

The fibers used in the present invention have a denier of about 0.9 to about 7. More preferably, the fibers have a denier of about 1 to about 3, and more preferably about 1.25 to about 2.

To adhere the flock material to the surface of the elastic article of the present invention, an elastic adhesive system is required and forms a critical aspect of the invention. Since the elastic article of the present invention is flexible, the adhesive used to adhere the flock to the article must also possess flexibility or elongation properties that are at least comparable to the elastic material used to form the article. Accordingly, through the use of such an elastic adhesive, not only is the overall elasticity of the elastic article maintained, the flock material embedded in the elastic adhesive does not separate from the adhesive. To achieve this result, the elastic adhesive preferably includes any polymer capable of providing the adhesive with an elongation of about 400% to about 1400% from its original state. More preferably, the adhesive has an elongation of about 600% to about 900%.

When the article of the present invention is a rubber-based glove, preferably, the adhesive system preferably includes a low temperature self cross-linking water dispersed acrylic emulsion. This low temperature acrylic adhesive system will cross-link at the same cure or cross-linking temperatures required for a rubber-based glove, which is usually 230 to 250° F., over a time range of 10 to 45 minutes depending on the product. Matching the cross-link temperatures and oven time requirements between the acrylic adhesive system and the rubber-based glove of the present invention is a critical manufacturing step. Acrylics that require at least 300° F. to cross-link can destroy the rubber-based portion of the glove or elastic article.

In addition, it has been found that the use of an acrylic adhesive system of the present invention can impart a soft, smooth, and silky, as well as a relaxed or cloth-like feel, to the body of the rubber-based glove. The unique combination of the low-temperature adhesive system, the rubber-based glove, and the electrostatic flock is critical to providing the soft, silky feel of the glove of the present invention.

Another critical element of the adhesive system of the present invention is that the adhesive system holds the flock during wet service. To further improve the high wet adhesion that is required for application to the glove of the present invention, which may be used with water and surfactant solutions, the adhesive may be adjusted to increase the wet bond. By way of example, the wet bond may be adjusted by the inclusion, in the adhesive, of one or more materials including, but limited to, resin compound, melamine-formaldehyde resin, polychloroprene rubber, acrylonitrile rubber, styrene-butadiene rubber, urethane or other synthetic rubbers, or any combinations thereof. Preferably, the adhesive is compounded with a melamine-formaldehyde resin to further waterproof the bond between the flock and the adhesive.

Also, a combination of two or more acrylics varying in durometer hardness may also be blended together to modify the wet adhesion as may be required for a product. Generally, the harder acrylics with less elongation can increase the wet adhesion. Also, when blended with the softer acrylics, the harder acrylics can impart wet adhesion while not significantly compromising the ease of elongation or flexibility of the elastic article. Therefore, higher concentrations of the harder acrylics lattices should increase bond strength.

Suitable acrylics for use in the adhesive system of the present invention include, but are not limited to, a variety of commercially available aqueous acrylic copolymer emulsions. Copolymer types are selected depending on film flexibility and time/temperatures required for cross-linking.

Suitable commercially available acrylic adhesives, include, but are not limited to, Acrygen® from Omnova, Nacrylic® from National Starch, Hycar® and HyStretch® from BF Goodrich, or any combinations thereof. Preferably, the acrylic adhesive used is Acrygen®, Nacrylic®, or any combination thereof.

Suitable non-acrylic adhesives that can be used in the present invention, depending on the product application, include, but are not limited to, any adhesive from polymers of natural latex, polychloroprene, acrylonitrile, styrene-butadiene, urethanes, or any combinations thereof, combinations with acrylics and melamine or other cross-linking resins and systems, or any combinations thereof.

To further achieve the soft, silky feel of the flocked surface of the rubber-based glove of the present invention, the flocked fibers are electrostatically oriented on the surface of the glove in a perpendicular, or virtually perpendicular, plane, meaning only one end of the straight, rod shaped fiber is inserted into the adhesive. This orientation of the electrostatically applied fibers in the adhesive also allows the adhesive to stretch or flex with ease, as opposed to random oriented fibers, which will bind up the adhesive. The perpendicular orientation of the electrostatic flocked fibers also allows for increased fiber packing or density over the surface of the adhesive to create a dense, smooth and level flocked surface. Therefore, the orientated fibers provide both a very smooth and silky feel to the surface of the glove. Because only the ends of the fiber are in the adhesive, it allows the adhesive to retain its elasticity and not to be bound up as random fiber flocking will do.

The present invention is also directed to a process for applying electrostatically flocked fiber to the surface of a rubber-based article, such as a glove. The process involves the orientation and delivery of electrostatically charged fibers into an adhesive layer applied to the surface of the glove. The fibers receive their orientation and momentum through an electrical charge and travel to the electrically grounded adhesive surface thus planting one end of the fiber in a general perpendicular position to the surface.

Referring to FIG. 1, a preferred apparatus for electrostatically applying flock to a rubber-based glove is represented generally by reference numeral 10. The apparatus has a flock delivery and recovery system represented generally by reference numeral 20, and a electrostatic flocking system represented generally by reference numeral 50.

The flock feed system includes a flock storage hopper 22 from which the flock metering system 24 feeds the proper portions of flock into the venturi 26. The flock delivery system 50 is generally operated by compressed or fan driven air 28. The air is driven through the venturi 26, or other mixing chamber, which propels the flock and air mixture to the electrically charged nozzle 52.

The electrostatic flock system 50 has one or more oscillating electrostatic flock nozzles 52. Each nozzle is AC or DC charged, depending on the system, by a power supply 54. Once the flock leaves nozzles 52, it is orientated by the electrical field, which is generated between an electrode 56 on the flock nozzle 52 and the grounded glove former 58. A combination of electrostatic charge and slight pneumatic pressure and nozzle oscillations will distribute the flock over the convoluted surfaces of a glove on glove former 58. The glove formers 58 onto which the glove film and adhesive have been applied in the previous manufacturing steps are moved through and past the flock nozzles 52 via a continuous chain conveyer system (not shown), the conveyer being part of the normal manufacturing process.

The excess flock 60 that does not adhere to a glove on glove former 58 is collected in flock collection unit 62. Excess flock 60 is sent by vacuum 64 to a separator/filter chamber 66, which expels clean air 68 through a filter 70. Gravity drops the flock to collector 72, where it can be reloaded into the feed hopper 22.

Flocked gloves are then conveyed through an oven (not shown) for drying and curing of the polymers to initiate the polymer cross-linking. At the end of the oven cycle, the glove is stripped from the former 58. The glove will undergo a separate washing and chlorination cycle (not shown) that is typical to glove manufacture. The washing and chlorination step will harden the outside rubber surface of the glove to de-tack the rubber and render it smooth or slippery to the touch.

While the apparatus depicted in FIG. 1 is described as operating continuously, it should be understood that it could easily be adapted to operate in the same fashion on a batch system basis.

It should be understood that the foregoing description is only illustrative of the present invention. Various alternatives and modifications can be devised by those skilled in the art without departing from the invention. Accordingly, the present invention is intended to embrace all such alternatives, modifications and variances.

I claim:

1. An elastic article comprising:

a layer of an elastic base material, a layer of an elastic adhesive positioned on at least one side of said layer of elastic base material, wherein said elastic adhesive has an elongation of about 400% to about 1400% of its original state; and a plurality of flocked material applied onto a side of said layer of elastic adhesive opposite said layer of elastic base material, wherein said elastic article meets a Tensile Set of under 40% of the original elongation when strained to at least 80% of an ultimate elongation of said elastic article.

2. The elastic article of claim 1, wherein said layer of elastic base material is a plurality of layers of elastic base materials.

3. The elastic article of claim 1, wherein said layer of elastic adhesive is a plurality of layers of elastic adhesive.

4. The elastic article of claim 1, wherein said elastic article meets a Tensile Set of under 30% of the original elongation when strained to at least 80% of the ultimate elongation of said elastic article.

5. The elastic article of claim 1, wherein said elastic article meets a Tensile Set of under 20% of the original elongation when strained to at least 80% of the ultimate elongation of said elastic article.

6. The elastic article of claim 1, wherein said layer of elastic base material is selected from the group consisting of natural rubber, synthetic rubber, and any combination thereof.

7. The elastic article of claim 1, wherein said elastic adhesive has an elongation of about 600% to about 900% of its original state.

8. The elastic article of claim 1, wherein said elastic adhesive is selected from the group consisting of an acrylic, natural latex, polychloroprene, acrylonitrile, styrene-butadiene, urethane, and any combinations thereof.

9. The elastic article of claim 1, wherein said elastic adhesive comprises an aqueous acrylic copolymer emulsion.

10. The elastic article of claim 8, wherein said elastic adhesive further comprises one or more additives selected from the group consisting of resin, melamine, formaldehyde, and any combinations thereof.

11. The elastic article of claim 10, wherein said elastic adhesive further comprises a melamine-formaldehyde resin.

12. The elastic article of claim 1, wherein said plurality of flocked material is selected from the group consisting of rayon, nylon, polyester, acrylic, and any combinations thereof.

13. The elastic article of claim 1, wherein said plurality of flocked material is a plurality of fiber.

14. The elastic article of claim 1, wherein said plurality of flocked material is a plurality of rayon fiber.

15. The elastic article of claim 13, wherein said plurality of fiber has a fiber length of about 0.005 inches to about 0.25 inches.

16. The elastic article of claim 13, wherein said plurality of fiber has a fiber denier of about 0.9 to about 7.

17. The elastic article of claim 1, wherein the elastic article is selected from the group consisting of glove, medical wrap, support wrap, and clothing.

18. The elastic article of claim 1, wherein the elastic article is a rubber-based glove.

19. A flocked glove comprising:

one or more elastic base materials, one or more layers of an elastic adhesive positioned on at least one side of said one or more layers of elastic base material, wherein said one or more layers of elastic adhesive have an elongation of about 400% to about 1400% of its original state; and a plurality of flocked material applied on a side or said one or more layers of elastic adhesive opposite said one or more layers of elastic base material, wherein said flocked glove meets a Tensile Set of under 40% of the original elongation when strained to at least 80% of an ultimate elongation of said flocked glove.

20. The flocked glove of claim 19, wherein said flocked glove meets a Tensile Set of under 30% of the original elongation when strained to at least 80% of the ultimate elongation of said flocked gloves.

21. The flocked glove of claim 19, wherein said flocked glove meets a Tensile Set of under 20% of the original elongation when strained to at least 80% of the ultimate elongation of said flocked gloves.

22. The flocked glove of claim 19, wherein said one or more elastic base materials is selected from the group consisting of natural rubber, synthetic rubber, and any combination thereof.

23. The flocked glove of claim 19, wherein said one or more layers of elastic adhesive has an elongation of about 600% to about 900% of its original state.

24. The flocked glove of claim 19, wherein said elastic adhesive is selected from the group consisting of an acrylic, natural latex, polychloroprene, acrylonitrile, styrene-butadiene, urethane, and any combinations thereof.

25. The flocked glove of claim 24, wherein said one or more layers of elastic adhesive further comprises one or more additives selected from the group consisting of resin, melamine, formaldehyde, and any combinations thereof.

26. The flocked glove of claim 24, wherein said one or more layers of elastic adhesive further comprises a melamine-formaldehyde resin.

27. The flocked glove of claim 19, wherein said one or more layers of elastic adhesive comprises an aqueous acrylic copolymer emulsion.

28. The flocked glove of claim 19, wherein said plurality of flocked material is selected from the group consisting of rayon, nylon, polyester, acrylic, and any combinations thereof.

29. The flocked glove of claim 19, wherein said plurality of flocked material is a plurality of fiber.

30. The flocked glove of claim 19, wherein said plurality of flocked material is a plurality of rayon fiber.

31. The flocked glove of claim 29, wherein said plurality of fiber is polarized fiber.

32. The flocked glove of claim 29, wherein said plurality of fiber has a fiber length of about 0.005 inches to about 0.25 inches.

33. The flocked glove of claim 29, wherein said plurality of fiber has a fiber denier of about 0.9 to about 7.

34. A method for making a flocked elastic article comprising the steps of:

forming an elastic base article, applying an elastic adhesive to a surface of said elastic base article, wherein said elastic adhesive has an elongation of about 400% to about 1400% of its original state; and flocking a plurality of fibers on a side of said elastic adhesive opposite said surface of said elastic base article, wherein said flocked elastic article meets a Tensile Set of under 40% of the original elongation when strained to at least 80% of an ultimate elongation of said flocked elastic article.

35. The method of claim 34, wherein said flocked elastic article meets a Tensile Set of under 30% of the original elongation when strained to at least 80% of the ultimate elongation of said flocked elastic article.

36. The method of claim 34, wherein said flocked elastic article meets a Tensile Set of under 20% of the original elongation when strained to at least 80% of the ultimate elongation of said flocked elastic article.

37. The method of claim 34, wherein said elastic base article is formed from one or more elastic layers of material.

38. The method of claim 37, wherein said one or more elastic layers of material are selected from the group consisting of natural rubber, synthetic rubber, and any combination thereof.

39. The method of claim 34, wherein said elastic adhesive has an elongation of about 600% to about 900% of its original state.

40. The method of claim 34, wherein said elastic adhesive is selected from the group consisting of acrylic, natural latex, polychloroprene, acrylonitrile, styrene-butadiene, urethane, and any combinations thereof.

41. The method of claim 40, wherein said elastic adhesive further comprises one or more additives selected from the group consisting of resin, melamine, formaldehyde, and any combinations thereof.

42. The method of claim 34, wherein said elastic adhesive comprises an aqueous acrylic copolymer emulsion.

43. The method of claim 40, wherein said elastic adhesive further comprises a melamine-formaldehyde resin.

44. The method of claim 34, wherein said plurality of fibers is selected from the group consisting of rayon, nylon, polyester, acrylic, and any combinations thereof.

45. The method of claim 34, wherein said plurality of fibers is a plurality of rayon fibers.

46. The method of claim 34, wherein said plurality of fibers is a plurality of polarized fibers.

47. The method of claim 34, wherein said plurality of fibers has a fiber length of about 0.005 inches to about 0.25 inches.

48. The method of claim 34, wherein said plurality of fibers has a fiber denier of about 0.9 to about 7.

49. The method of claim 34, wherein said flocking is electrostatic flocking.

50. The method of claim 49, wherein said electrostatic flocking orients said plurality of fibers in a perpendicular or virtually perpendicular plane relative to said surface of said elastic base article.

51. The method of claim 34, wherein said flocked elastic article is selected from the group consisting of glove, medical wrap, support wrap, and clothing.

52. The method of claim 34, wherein said flocked elastic article is a rubber-based glove.

* * * * *